United States Patent [19]

Mason et al.

[11] 4,074,540

[45] Feb. 21, 1978

[54] TOOL SYSTEM FOR SUBMERGIBLE CHAMBER

[76] Inventors: Burton Hoster Mason, P.O. Box 504, Covington, La. 70433; Marvin Feldman, 788 Columbus Ave., New York, N.Y. 10025

[21] Appl. No.: 665,628

[22] Filed: Mar. 10, 1976

[51] Int. Cl.[2] ..... B63C 11/40

[52] U.S. Cl. ..... 61/69 R; 61/63; 114/16 R

[58] Field of Search ..... 61/69 R, 63, 69 A; 173/DIG. 1; 166/.5, .6; 29/26 A, 568; 214/1 CM; 114/16 R, 50, 51; 81/57.5, 57.42, 57.11, 57.24, 57.12, 57.13, 57.25, 57.31, 57.4, 57.44, 57.45

[56] References Cited

U.S. PATENT DOCUMENTS

| | | | |
|---|---|---|---|
| 3,263,300 | 8/1966 | Schatzman et al. | 29/26 A |
| 3,367,299 | 2/1968 | Sayre | 61/69 A X |
| 3,442,175 | 5/1969 | Heap et al. | 29/26 A |
| 3,451,224 | 6/1969 | Colechia et al. | 114/16 R X |
| 3,593,408 | 7/1971 | Walker | 81/57.22 UX |
| 3,661,050 | 5/1972 | Erikson | 29/26 A |
| 3,717,000 | 2/1973 | Rothwell | 61/69 R |
| 3,851,491 | 12/1974 | Mason | 61/69 R |

*Primary Examiner*—Dennis L. Taylor

*Attorney, Agent, or Firm*—Marvin Feldman; Stephen E. Feldman

[57] ABSTRACT

A manned or remotely controlled submergible chamber or tool carrier is provided with tool connection and disconnection to the work arm at an underwater location. A plurality of tools are mounted in a rack and each tool may be selectively connected and disconnected to a hydraulic drive means at the outward end of the retractably extensible portion of the work arm. All tool changing operations are remotely controlled from within the chamber or a remote station, as the operator views the tool changing operation. This tool system permits continuity of work arm operations without the need for the chamber to surface for tool changing. This tool changing system is particularly useful in performing work functions on underwater wellheads.

20 Claims, 4 Drawing Figures

TOOL SYSTEM FOR SUBMERGIBLE CHAMBER

This invention relates to a tool system for use at an underwater location. Specifically this invention relates to a tool system for selectively changing tools on a work arm of a manned submergible chamber.

In U.S. Pat. No. 3,851,491 there is disclosed a manned submergible chamber having a work arm and a tool mounted on the outward end of the work arm. While this submerged chamber was suitably designed to perform the desired tool work functions, it was necessary to either surface the chamber for tool changing or have divers perform the tool changing at the undersea location.

There is now provided by the present invention a tool system for selectively changing tooling at an underwater location without the need for surfacing or diver assistance.

It is therefore an object of this invention to provide a method and apparatus for changing tooling on a work arm of a submerged chamber.

It is a further object of this invention to provide a method and apparatus for selectively connecting or disconnecting a tool from a tool rack to a tool drive means.

It is still a further object of this invention to provide a method and apparatus as immediately aforesaid wherein the tool drive means is mounted at the outward end of the retractably extensible portion of the work arm.

It is still a further object of this invention to provide a method and apparatus as aforesaid wherein the tool rack is movable so as to align the desired tool with the tool drive means.

It is still a further object of this invention to provide means to securely connect while permitting subsequent disconnection of a tool with the tool drive means by remote operation from within the manned chamber.

It is still a further object of this invention to provide a tool connection means as immediately aforesaid wherein the tool locks in place in the tool drive means upon connection therewith.

It is still a further object of this invention to provide a tool system wherein a plurality of tools are selectively connected at the end of a work arm and each tool thereof may be selectively moved into position to perform its intended work function.

It is still a further object of this invention to provide a tool system for a manned chamber wherein the tool work functions as well as the tool changing functions are remotely performed by an operator from within the chamber, and wherein said functions are viewable from within said chamber.

Another object of this invention is to provide a method and apparatus which is safe and practical for employing at subsea locations and yet such apparatus is readily fabricated and of relatively inexpensive construction and practical in design and operation.

Further objects and advantages of the present invention will become apparent from the following description and the accompanying drawings which illustrate certain presently preferred embodiments of the invention and wherein.

Figure 1:
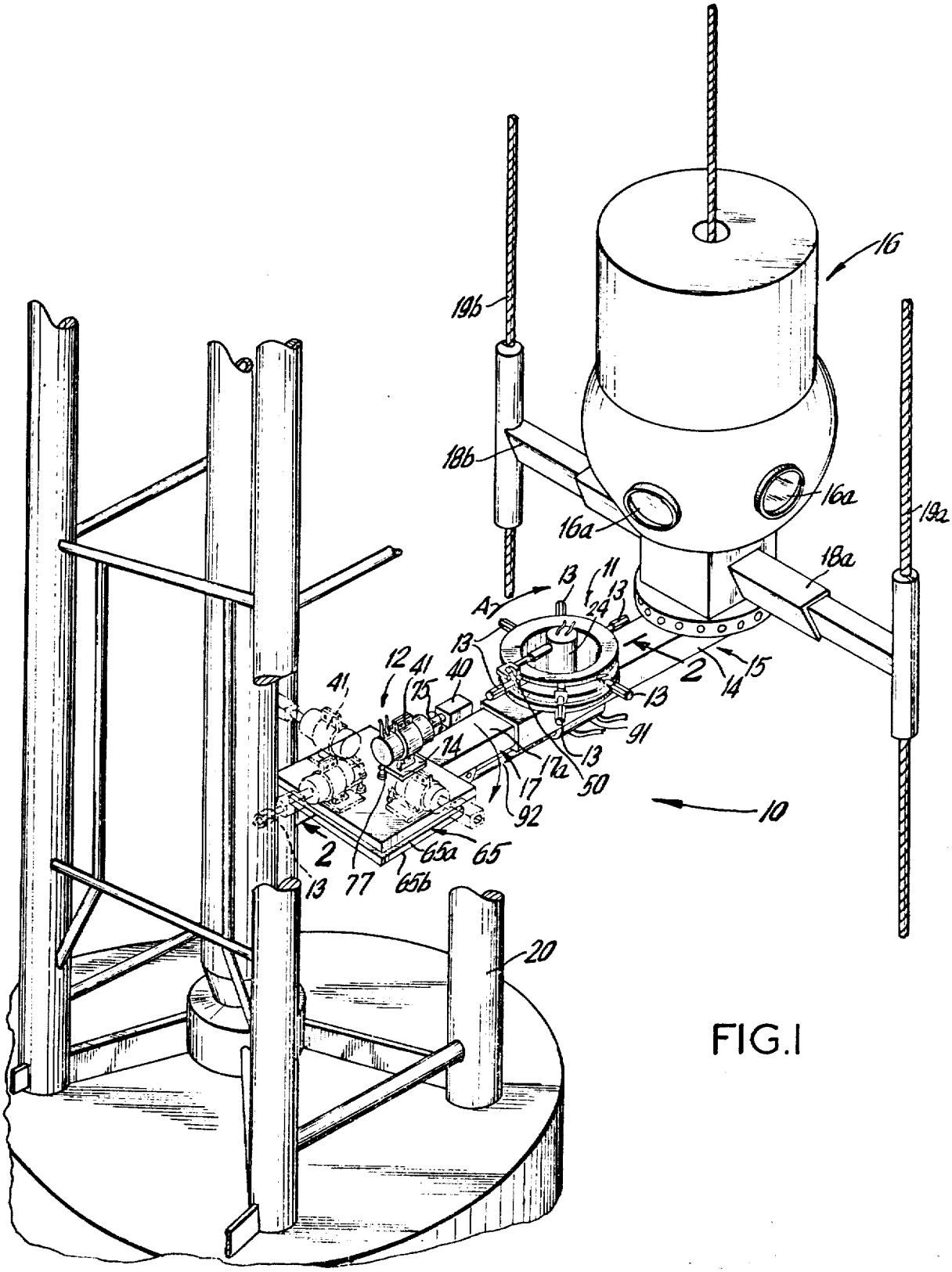
FIG. 1 is a perspective view of the invention as employed at an undersea work station.
Figure 2:
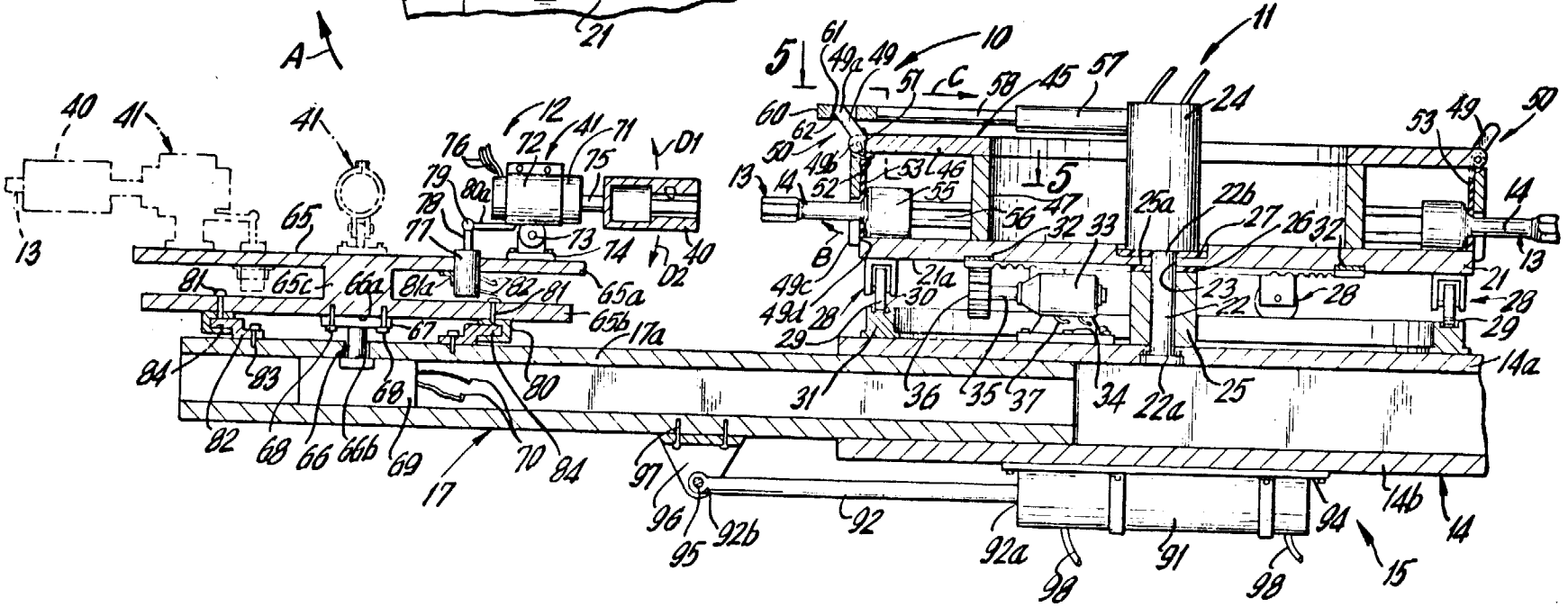
FIG. 2 is an enlarged sectional view taken along line 2—2 of FIG. 1.

Referring to FIGS. 1 and 2 there is shown the apparatus of this invention generally designated as numeral 10. The apparatus 10 in a broad aspect comprises a tool rack assembly 11 for a plurality of tools 13 (typical) and a tool drive assembly 12. The tool rack assembly 11 is mounted to the non-extensible portion 14 of work arm 15 for submergible chamber 16, whereas the tool drive assembly 12 is mounted on the retractably extensible portion 17 of work arm 15.

The submergible chamber 16 generally comprises a pair of outwardly extending guide arms **18*a* and 18*b* grippingly engaging a pair of vertically disposed guide wires 19*a* and 19*b* respectively, to hold the chamber in juxtaposition to undersea oil wellhead station 20, so as to permit the tool drive assembly 12 in combination with the tool rack assembly 11, to perform a plurality of work functions with interchanging the work tools without surfacing of the chamber 16. View ports 16*a* of chamber 16** permit viewing of all tool changing and work operations from within the manned chamber, or by television from a surface station.

The construction of chamber 16 may be that as generally shown and described in U.S. Pat. No. 3,851,491 issued Dec. 3, 1974.

Tool rack assembly 11 comprises a circular plate 21 rotatably disposed to fixed axial shaft 22 which is received in central hole 23 of plate 21. Shaft 22 at shaft end **22*a* is mounted to the top frame member 14*a* of fixed work arm portion 14. The other end 22*b* of shaft 22 supports hydraulic assembly 24 for purposes hereinafter appearing. A collar 25 surrounds shaft 22 and rests on the top surface of arm frame portion 14*a*, and a Teflon gasket 26 is mounted at the upper end 25*a* of collar 25. In this manner collar 25 and gasket 26 support plate 21 to permit plate 21 to rotate about the shaft axis. Another Teflon gasket 27 is disposed between hydraulic assembly 24 and plate 21 to assure smooth rotation of plate 21**.

A plurality of flange mounter roller assemblies 28 (typical) are mounted to the underside **21*a* of plate 21. Each assembly 28 has a freely rotatable roller 29, which roller 29 resides in groove 30 of annular track 31. Track 31 in turn is fixedly mounted on fixed arm portion 14*a* and the annular track is coaxial with shaft 22. An annular gear rack 32 is also mounted to plate underside 21*a* and is likewise coaxial with shaft 22. A drive assembly 33 is mounted to fixed arm member 14*a* by bolts 34. Drive assembly 33 is provided with a rotatable shaft 35 to which is mounted gear 36, and wherein the teeth of gear 36 enmesh with the teeth of rack 32. Drive assembly 33 is interconnected (not shown) to chamber 16 by power transmission conduits 37 so that the drive assembly may be actuated from with the manned submergible chamber 16**.

A plurality of tools 13 (typical), particularly, but not necessarily limited to socket wrenches, are mounted on plate 21 and the tool shafts 14 (typical) are radially transversely disposed to the axis of shaft 22. Further the tool axis is coaxial with the axis of the connector 40 of tool drive 41, of which it is in end face opposition, as shown in FIG. 2.

With the actuation of drive assembly 33 gear 36 rotates in turn, through gear rack 32, rotating plate 21, in the direction of arrow A, so that each tool 13 in turn may be coaxially aligned with a connector 40.

Each tool 13 is housed in frame 45, which frame 45 comprises an annular top plate 46 and an annular vertically disposed ring 47, connected to and supporting plate 46. Ring 47 is in turn welded to plate 21. A tool locking assembly 50, comprises a locking member 49 which is transversely rotatably mounted to plate 46 at pin 51, and a spring 52 is also mounted on pin 51 to permit spring-return of the member 49. Member 49 comprises an upper flange portion **49*a*, an integral intermediate portion 49*b* for receiving pin 51, and an integral yoke portion 49*c*. Yoke portion 49*c* is formed with a rubber bumper 53. As shown in FIG. 2, tool 13 is locked by member 49 in assembly 11. Specifically, yoke 49*c* encompasses tool shaft 14, with yoke lip 49*d* abutting plate 21. Bumper 53 is compressed between yoke 49*c* under the spring 52 force and the female wrench head 55. Wrench head 55 is slidably engaged on male shaft 56 which is fixedly transversely mounted to ring 47. That is head 55 is held between yoke 49*c* and shaft 56**.

Figure 5:
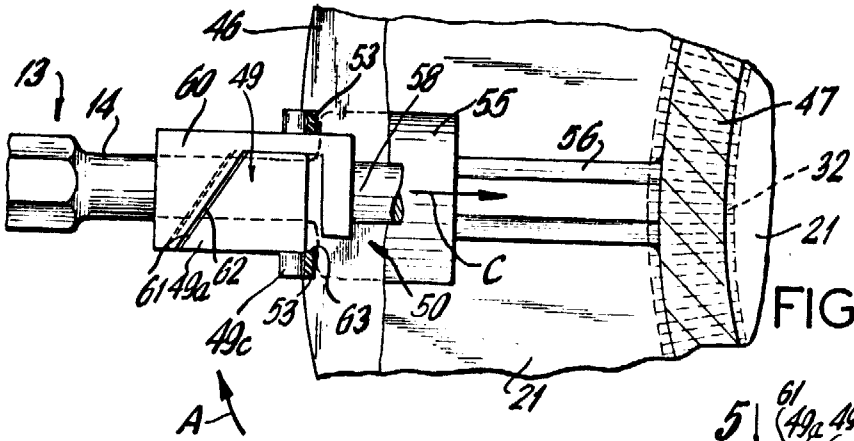
FIG. 5 is an enlarged partial plan view taken along line 5—5 of FIG. 2.

To unlock the tool for connection with connector 40, member 49 is rotated in direction of arrow B of FIG. 2. To effect this rotation of member 49, a cylinder 57 and its retractably extensible ram 58 are provided; cylinder 57 being operably mounted to hydraulic assembly 24. A flange 60 is formed on the outward end of ram 58 for engaging lock member flange **49*a*. Specifically referring to FIG. 5, member portion 49*a* is formed with an acutely slanted face 61 which abuts face 62 of ram flange 60, when member portion 49*a* is received in recess 63 formed in flange 60. This receiving of 49*a* in 63, and abutment of surface 61 and 62, occurs when plate 21 rotates in the direction of arrow A. With the aforesaid abutment tool 13 is aligned with tool drive connector 40 and then ram 58 is retracted in cylinder 57, as shown by arrow C, so that member 49 rotates as by arrow B, and surfaces 62 and 61 are in sliding engagement. Once yoke 49*c* is rotated sufficiently so that lip 49*d* clears the major diameter of head 55. With the further retraction of ram 57, surfaces 62 and 61 are slidingly disengaged, thus permitting the member 49 to return to the locked position by return rotation of spring 52. Of course the tool is first connected to connector 40 and removed from rack assembly 11, prior to causing such further retraction of ram 57 thereby permitting the release and return of member 49*c*** as aforesaid.

Tool drive assembly 12 comprises a rotatable double-flanged mounting plateform 65. Four similar tool drives 41 are mounted on platform 65 and radially disposed at 90°. Platform 65 is mounted to one end **66*a* of axial rotatable shaft 66 by flange 67 and bolts 68. Shaft 66 passes through hole 68 of frame portion 17*a* of retractably extensible work arm portion 17. The other end 66*b* of shaft 66 is mounted to hydraulic drive 69, which is housed within the frame portion of work arm portion 17. Hydraulic lines 70 interconnect drive 69 with chamber 16, so that drive 69 may be actuated from within the manned chamber. With the actuation of drive 69, each connector 40 of each tool drive 41 may be coaxially aligned with the shaft 14 of tool 13, and after connection is made with the tool, the tool may be rotated 180° so that it is outwardly disposed and facing work station 20 for performing work thereon, (FIG. 1**).

Platform 65 comprises upper plate **65*a* and lower plate 65*b* integrally connected by hub 65*c*. An annularly disposed channel 80 is bolted to plate 65*b* by bolts 81, and an annular flange 82 is bolted to arm portion 17*a* by bolts 83. Flange portion 84 is slidably received in channel 80, and supports the weight of the plate 65 together with the several tool drives. With the rotation of platform 65 flange portion 84 slides in channel 80**.

Each tool drive 41 comprises a hydraulic cylinder 71, held within frame 72, and pivotally mounted at pin 73 to base 74 which in turn is bolted to top plate **65*a* of platform 65. A rotatable shaft 75 is operably mounted to drive cylinder 71 so as to be rotated thereby and connector 40 is mounted to shaft 75 for rotation therewith. Hydraulic lines 76 provide interconnection between drive cylinder 71 and chamber 16 for actuation from within chamber 16. A hydraulic cylinder 77 and ram 78 are pivotally interconnected at 79 to arm 80*a* fixed to drive 41, for each such drive. Cylinder 77 is mounted to plate 65*a* by bolted flange 81*a*. With the retraction and extension of ram 78, drive 41 is pivoted in the directions of arrows D1 and D2, respectively. This permits a wide latitude of movement of the connected tool for performing work at station 20. Hydraulic lines 82 interconnect to chamber 16 for actuation from within chamber 16**.

Figure 3:
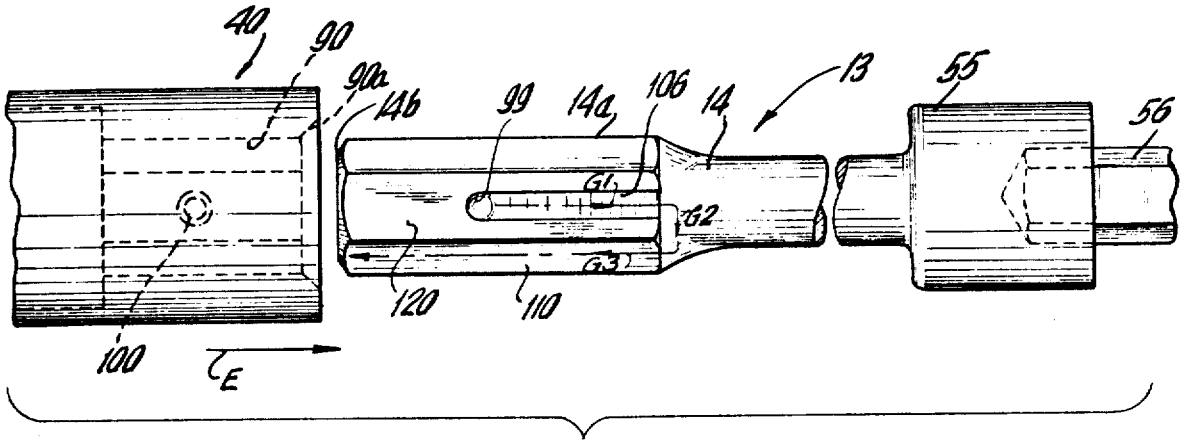
FIG. 3 is an enlarged view showing a work tool being engaged by the tool drive connector.
Figure 4:
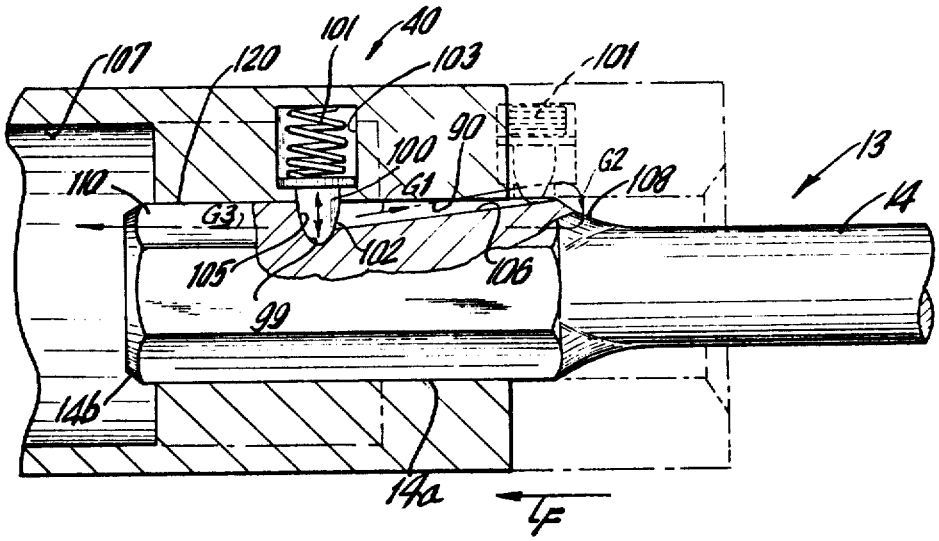
FIG. 4 is an enlarged view showing the work tool engaged and locked in the tool drive connector.

Referring now specifically to FIGS. 2–4, there is shown tool 13 comprising a shaft or shank 14 being formed with a polygonal shank end **14*a* and a female socket wrench 55 at the other end. End 14*a* is formed to slidably, non-rotatably engage polygonal recess 90 of tool drive connector 40. Recess 90 is formed with a chamfer 90*a* to permit ready insertion of shank end 14*a*. Shank end 14*a* may likewise be chamfered as at 14*b*. With tool 13 locked in assembly 11, shank 56 is engaged in the female socket 55 as depicted in FIG. 3** for illustrative purposes.

A hydraulic cylinder 91 is mounted by plate 94 to frame member **14*b* of fixed arm 14, and one end 92*a* ram 92 is retractably extensible in cylinder 91. The other end 92*b* of ram 92 is mounted by pin 95 to angle flange 96 which in turn is mounted to arm portion 17 by bolts 97. In this manner of construction, work arm portion 17 is retractably extensible with and received in work arm portion 14, by the retraction and extension of ram 92 through actuation of cylinder 91. Hydraulic lines 98 interconnect to chamber 16**.

Further with the retraction of arm portion 17, tool connector 40 is moved into engagement with locked tool 13 as depicted by arrow E of FIG. 3, and shank portion **14*a* is received in recess 90 as shown in FIG. 4. Shank portion 14*a* is formed with a transverse tapered hole 99 for receiving pin 100. Pin 100 is housed in connector 40, and is extended into recess 90 by compression spring 101. Pin 100 is formed with taper 102 which first abuts chamfer 14*b* during initial engagement, and with further engagement of pin 100 on polygonal surface 120, pin 100 is recessed in housing 103 with spring 101 under compression, and with still further engagement, pin 100 entends into tapered hole 94 of shank portion 14*a* to thereby lock the tool 13 in connector 40**.

Locking member 49 is then rotated to unlock tool 13 and with the extension of ram 92 connector 40 with the locked tool 13 moves away from tool rack assembly 11, as shown by arrow F of FIG. 4. With this movement, shaft 56 is disengaged from socket wrench head 55. It is to be borne in mind that the movement of connector 40 causes pin 100 to abut surface 105 of shank hole 99, locking the tool in the connector.

Once the tool 13 is locked in connector 40, platform 65 may be rotated 180° so that the tool is in position to perform work on station 20.

After the desired work function is performed, and to disengage the tool from the connector, platform 65 is again rotated 180° so that the connected tool is coaxial with the shaft 56 of the tool rack assembly. Locking member 49 is then rotated by ram 58 so that the member 49 is clear so as to permit the tool 13 to be returned to the assembly 11. Ram 92 is then retracted until wrench head 55 is fully received on mating shaft 56. Locking member 49 is then further rotated to permit spring-return, locking tool 13 in yoke portion 49*c*. Then ram 92 is further retracted to cause connector 40 in slide over shank portion 14*a*, and taper 102 of pin 100 slides in groove 106 of shank 14*a* as shown by arrow G1 of FIG. 4. Insofar as groove 106 is inclined, pin 100 retracts into housing 103 with the continued movement of connector 40 as shown by the broken line configuration of FIG. 4. With such continued movement pin 100 abuts shoulder 108 of cylindrical shaft portion 14 and the entire shank portion resides in recess 107 of connector 40. At this point, tool drive 41 is actuated to rotate connector 40 (only) through an angular increment so that pin 100 travels as shown by arrow G2 of FIG. 4. At this point pin 100 is adjacent another face 110 of polygonal shank portion 14*a*. Ram 92 is then extended so that connector 40 travels as per arrow F of FIG. 4 and pin 100 slides in a recessed state on surface 110 as depicted by arrow G3 of FIG. 4. Connector 40 continues to move away from tool 13 so as to return to the position as shown in FIG. 1.

It is to be borne in mind that recess 107 is of greater axial dimension that the axial length of shank portion 14*a*, and is of greater diameter than connector recess 90, so as to permit the connector to freely rotate in relation to tool 13, when pin 100 has reached tool shoulder 108.

In the aforesaid manner of construction and operation, a plurality of tools may be selectively aligned with, assembled and disassembled to a plurality of tool drives while remaining at a subsea location. By standardizing the sizing of the tool shank portions 14*a* and the connector recesses 40, this becomes even more apparent.

It is also within the contemplation of this invention to provide tool members in addition to the socket wrench as depicted in the preferred embodiment. Other rotatable work tools are also within the contemplation of this invention. Further while rotatable tool drives are depicted, other tool drive means are also within contemplation of this invention.

It is also to be understood that the plurality of hydraulic lines may be conveniently coupled to minimize the number of lines being interconnected to the submergible chamber. Still further the various types of drives may be remotely actuated as by electrical connections, radio command signals and the like.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool system for a submergible chamber comprising tool drive means mounted at the outward end of a work arm for the chamber, said tool drive means comprising means to connect a tool therewith, means to mount a plurality of tools so as to be disposed between the tool drive means and the chamber, so that at least one of said tools is in alignment with said connection means, and means associated with said work arm to provide movement between said tool drive means and said one tool, so that the tool connects with the tool drive means, whereby the connection of the tool to the tool drive means provides use of the tool in conjunction with the submerged chamber operation at an underwater work station, without the need for surfacing the chamber.

2. The tool system of claim 1, said tool drive means being rotatably mounted and further comprising means to rotate the tool drive means so that in one position the tool drive means is in alignment with said one tool and in another position said tool drive means is disposed away from said plurality of tools in position to perform the tool work function.

3. The tool system of claim 1, further comprising a tool rack for holding said plurality of tools mounted between said tool drive means and said chamber, means to move said tool rack relative to said work arm so that selectively each of the tools of said plurality is in alignment with the connection means.

4. The tool system of claim 1, wherein the work arm comprises a retractably extensible portion and the tool drive means is mounted at the outward end thereof, and wherein said means to provide movement comprising the retraction of the work arm for tool connection.

5. The tool system of claim 1, wherein the connection means and the portion of the tool connecting therewith being formed with means to lock the tool therein.

6. The tool system of claim 3, wherein said means to move said tool rack comprises a gear rack mounted on said tool rack and a rotatable pinion engaging said gear rack.

7. The tool system of claim 2, further comprising a plurality of drive means mounted on said means to rotate the drive means, so that each of said drive means may in turn be brought into alignment for tool connection or disconnection.

8. The tool system of claim 3, further comprising means to mount said tool rack to the work arm.

9. The tool system of claim 8, wherein the work arm comprises a retractably extensible portion and wherein the tool drive means is mounted on said retractably extensible portion and wherein the tool rack is mounted on another portion of the work arm, and wherein said means to provide movement comprising the retraction of the work arm for tool connection.

10. The tool system of claim 8, further comprising a tool rack mounted between said tool drive means and said chamber for holding said tools, means to move said tool rack relative to said work arm so that selectively each of the tools of said plurality is in alignment with the connection means.

11. The tool system of claim 10, further comprising means to pivotally mount said tool rack to said other portion of the work arm.

12. The tool system of claim 3, further comprising means to lock said tool in said rack.

13. The tool system of claim 12, further comprising means to unlock said tool in said rack to permit connection with the tool drive means.

14. The tool system of claim 1, said tool drive means being mounted on a rotatable platform and wherein said means to move said platform so that said tool connects with the tool drive means.

15. The tool system of claim 1, said connection means comprising a female connector and said tool being formed with a shank for connection therewith.

16. The tool system of claim 15, further comprising means to lock said shank in said female connector.

17. The tool system of claim 16, said lock means comprising a spring-loaded pin housed in said female connector and said shank being formed with a recess to lockingly receive said pin upon connection of the tool.

18. The tool system of claim 17, further comprising a tool rack mounted between said tool drive means and said chamber for holding said tools, means to move said tool rack relative to said work arm so that selectively each of the tools of said plurality is in alignment with the connection means, further comprising means to lock said tool in said rack, further comprising means to remove said pin and disconnect said tool with said tool locked in said rack.

19. The tool system of claim 2, further comprising means to pivot said tool drive means, wherein the pivot axis is transverse to rotation axis.

20. The tool system of claim 2, further comprising means to connect said drive means to said chamber, means to connect the means to rotate the drive means to said chamber and means to connect said means to provide movement to said chamber so that said tool system is remotely operable from within said chamber.

* * * * *

UNITED STATES PATENT OFFICE

CERTIFICATE OF CORRECTION

Patent No. 4,074,540 Dated February 21, 1978

Inventor(s)

It is certified that error appears in the above-identified patent and that said Letters Patent are hereby corrected as shown below:

Figures 1 thru 6 of the drawings should be deleted and substituted with the attached Figures 1 thru 4 therefore.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*